United States Patent [19]

McCoy

[11] Patent Number: 4,867,833

[45] Date of Patent: Sep. 19, 1989

[54] BUTT-CUT LABEL DISPENSER

[75] Inventor: Gary McCoy, Evans City, Pa.

[73] Assignee: Carl Strutz & Company, Inc., Mars, Pa.

[21] Appl. No.: 95,687

[22] Filed: Sep. 14, 1987

[51] Int. Cl.[4] ..... B65H 69/06

[52] U.S. Cl. ..... 156/361; 156/363; 156/542; 250/223 R; 250/571

[58] Field of Search ..... 156/64, 361–363, 156/542, 58; 250/570, 571, 491.1, 223 R; 242/68.2

[56] References Cited

U.S. PATENT DOCUMENTS

| | | | |
|---|---|---|---|
| 2,723,086 | 11/1955 | Russell | 242/72 |
| 3,228,678 | 1/1966 | Koger | 242/68.2 X |
| 3,729,362 | 4/1973 | French et al. | 156/363 X |
| 4,217,491 | 8/1980 | Dufford et al. | 250/223 R |
| 4,502,910 | 3/1985 | Voltmer et al. | 156/566 X |
| 4,546,384 | 10/1985 | Kowalski | 250/223 R X |
| 4,555,281 | 11/1985 | Mattei et al. | 156/64 |

*Primary Examiner*—David Simmons

*Attorney, Agent, or Firm*—Clifford A. Poff

[57] ABSTRACT

A label dispenser for automatically applying butt cut labels from a dispensing roll onto workpieces positioned on a conveyor system. A web with adhered edge to edge labels in coiled form is rotatably supported above the conveyor and caused to unwind by pinch rollers. Unwound portions of t he web are caused to wrap around a circumferential portion of a roller, thereby accentuating gaps created by the cut lines. A sensor detects the accentuated cut line between adjacent labels and generates an electrical signal responsive to times when a cut is detected. The signal controls the operation of the drive roller such that a single label is applied to an article on the conveyor system.

21 Claims, 6 Drawing Sheets

10
11
12
13
14
15
16
17
18
19
21
22
23
24
25
26
27
28
29
30
31
32
33
34
36
37
38
39
40
40A
40B
41
42
43
44
45
II
II

BUTT-CUT LABEL DISPENSER

BACKGROUND OF THE INVENTION

1. Field of the Invention

The present invention relates generally to labeling apparatus, and, more particularly, to an apparatus for dispensing butt-cut labels on each of a succession of products or containers.

2. Description of the Prior Art

In order to increase the efficiency of labeling operations and processes, both with respect to cost and quality, many operations previously performed manually or semiautomatically have been automated.

Among those processes which may be automated are many processes which are utilized in the labeling of articles and/or containers used in retail trade. One such process involves the affixing of labels, such as price stickers, UPC Codes, advertisement or decorative labels or any other printing desired to meet working requirements or desires. The label can be applied to the containers for goods or directly on the goods.

Presently, label dispensers to perform an automatic labeling function can operate only with spaced apart and discrete labels adhered to a web which is used as a carrier. Die cut labels are one typical example of such labels. Die-cut labels are spaced apart on a web by a large gap (typically 0.125 inch) whereby edge detectors can discriminate between the trailing edge of one label and the leading edge of the next label on a web for allowing a proper index function by a drive of the dispenser. Each time the dispenser is indexed by a drive the web is advanced a predetermined distance to individually dispense the succession of labels. The waste of label material that must be removed and discarded in order to form the gap between label as well as the additional length of web which must be provided add significantly to the cost of the labeling system. Butt-cut labels are much less expensive to produce, but cannot be used with existing dispensers because a single cut line separates adjacent labels on the web. The cut line is quite narrow; only about 0.001 of an inch which is inadequate for the operation of a detector used for an indexing control function of known forms of die cut label dispenser.

SUMMARY OF THE PRESENT INVENTION

It is therefore the object of the present invention to provide a label dispenser for automatically dispensing labels abutting one another on a substrate used to carry the labels to containers which can, if desired be moved along a course of travel by a conveyor or the like.

In accordance with the present invention, there is provided an apparatus for dispensing labels from a web onto an article, the apparatus including, label supply means including a web having adhered labels in an edge-to-edge and abutting relation along one face surface of the web, sensing means directed toward exposed face surfaces of labels while carried by the web for producing an electrical signal in response to identifiable indicia by scanning from abutting label to label, peeler means for releasing at least an adhered part of a label from the web, and drive means responsive to the electrical control signal for controlling advancement of the web a predetermined distance sufficient to dispense a label from the web at the peeler means.

The sensing means may include a scanner such as a television camera for producing an actual frame of a video electrical signal corresponding to a label or a part thereof within the field of view of the camera, a storage medium for producing a desired video electrical signal corresponding to a video reference frame of a label or predetermined part thereof; and means for producing an electrical control signal when the actual frame of video electric signal matches the desired frame of video electrical signal. The aforesaid drive means is responsive to the electrical control signal for controlling advancement of the web.

According to the preferred embodiment of the present invention, the apparatus for releasing adhered labels includes a supply means for labels adhered to a web in an edge-to-edge and abutting relation along one face surface thereof, means having an arcuate surface for flexing the web to accentuate edge portions of abutting labels, sensing means directed toward a face surface of a label carried by the web while supported by the arcuate surface for producing an electrical signal in response to a detection of an accentuated edge portion of abutting labels, peeler means for releasing at least an adhered part of a label from the web, and drive means responsive to the electrical signal for advancing the web a predetermined distance sufficient to dispense a label from the web at the peeler means.

The supply means may, for example, include a spindle supported and coupled to a web tensioning means such as a brake or a slip clutch. The drive means for advancing the web may include a roller driven by a motor. Preferably the driven roller cooperates with a second roller to form a pinch roll assembly wherein the web wraps about ma]or portion of the driven roller to establish a positive driven relationship with the driven roller. A driven take-up reel can be arranged to coil the web after the labels are dispensed. The take-up reel can be used to form the drive means for advancing the web but it is preferred to employ driven pinch rollers because the web speed will remain constant.

The sensing means is positioned in the path of travel by the web between the supply means for the web and the peeler means. The sensing means generates a signal during a time when a cut is sensed. The sensing means may, for example, include a light emitting means and a light receiving means with the light emitting means emitting the light toward a label on the web while drawn along an arcuate surface of an anvil member, and the light receiving means receiving light reflected from the gap between accentuated edge portions of abutting labels. The light receiving means may then generate a signal during those times in which the amount of reflected light is altered due to reflection of light from the web exposed by a cut when accentuated between adjacent butt-cut labels on the web. The drive means is controlled in response to the signals generated by the sensing means to control the operation of a drive used to advance the web along the peeler means. In the preferred embodiment, a workpiece detector provides a signal to actuate a clutch when a workpiece is detected for advancing labels and then a controller receives a signal from a label sensor to deactuate the clutch when the next cut between labels is sensed. The peeler means allows individual ones of the butt-cut labels to be removed from the web and dispensed on a workpiece. An applicator may, for example, be arranged between the elongated peeler bar and the workpiece to firmly affix labels on the workpieces. As the web passes along the peeler bar, the web wraps around a reverse edge where the labels are peeled away from the web. A reel or spool winder may be included for coiling the scrap portions of the web after the butt-cut labels have been applied to the workpieces. The winder may be comprised of a rotatable spindle and a reel positioned thereon to receive and coil the web. The scrap winder is provided with a drive designed to always maintain tension on the web. A brake is operated to prevent an unwanted pay out of labels from the supply reel.

BRIEF DESCRIPTION OF THE DRAWINGS

These features and advantages of the present invention will be better understood when the following description is read in light of the accompanying drawings in which.

DESCRIPTION OF THE PREFERRED EMBODIMENT

Figures 1, 3:
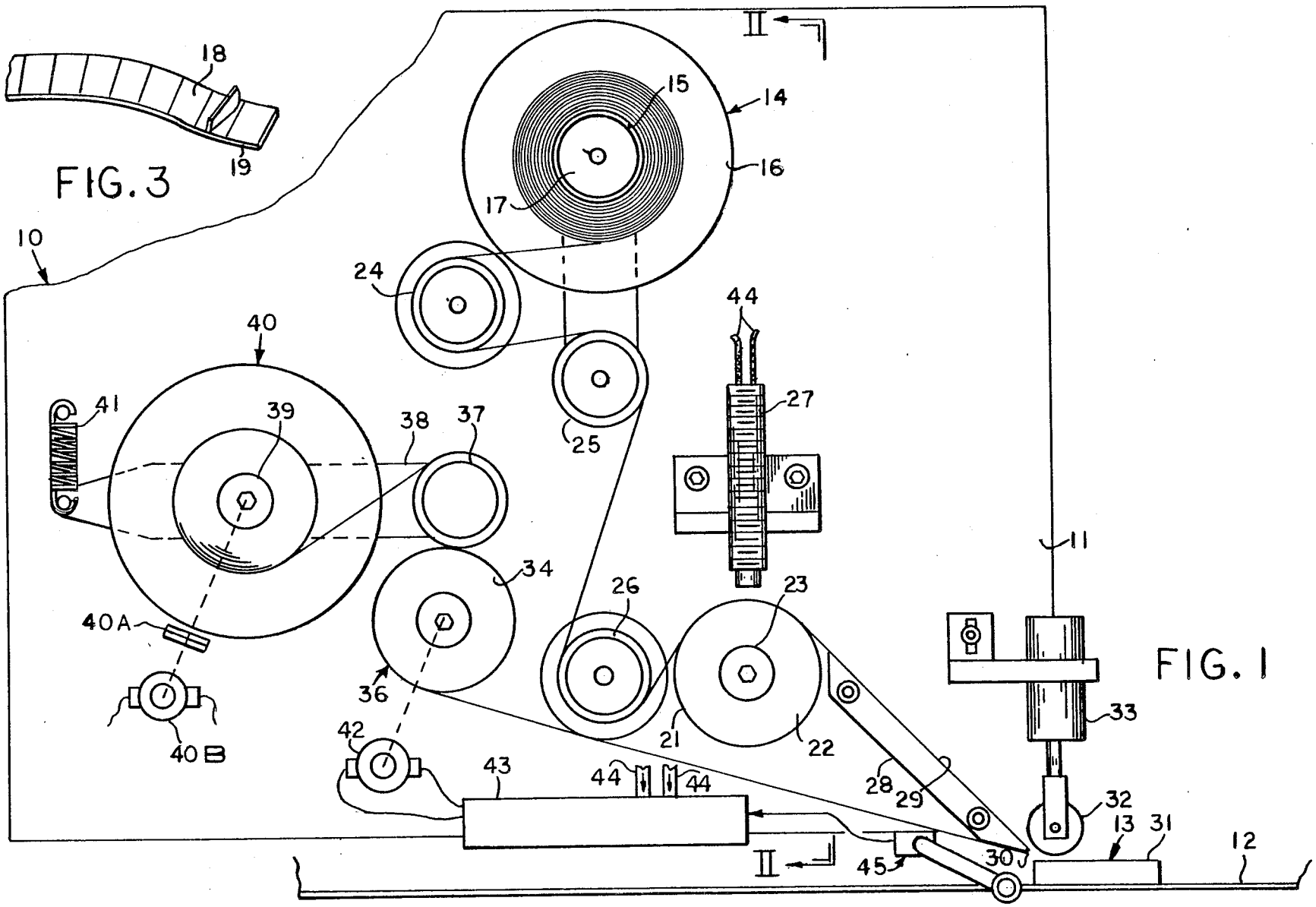
FIG. 1 is a side view, in elevation, of the label dispenser of the present invention.
FIG. 3 is a schematic illustration of a portion of a roll of butt-cut labels.
Figure 2:
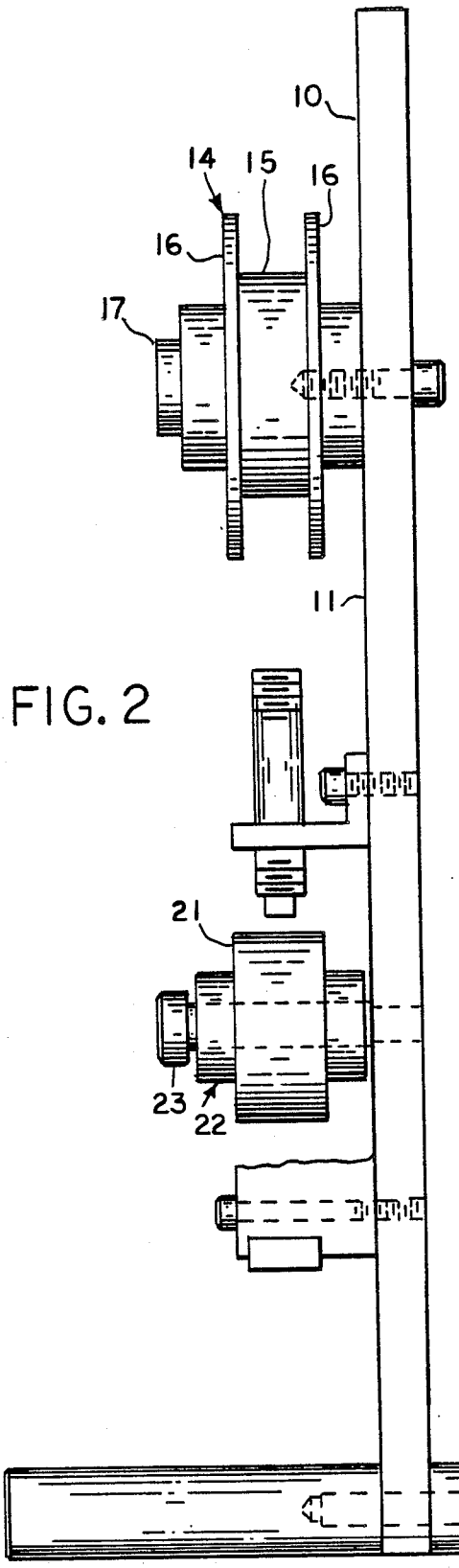
FIG. 2 is a sectional view taken along line II—II of FIG. 1.

Referring now to FIGS. 1 and 2A, there is shown a preferred embodiment of the butt-cut label dispenser according to the present invention. The dispenser is identified by reference numeral 10 and includes a suitable housing, shown in the preferred embodiment as a housing plate 11 secured in a suitable manner at position proximate to a conveyor 12. The conveyor carries workpieces such as articles or containers along a path of travel to labeling station 13 where a label is dispensed onto each of the workpieces.

Figure 4:
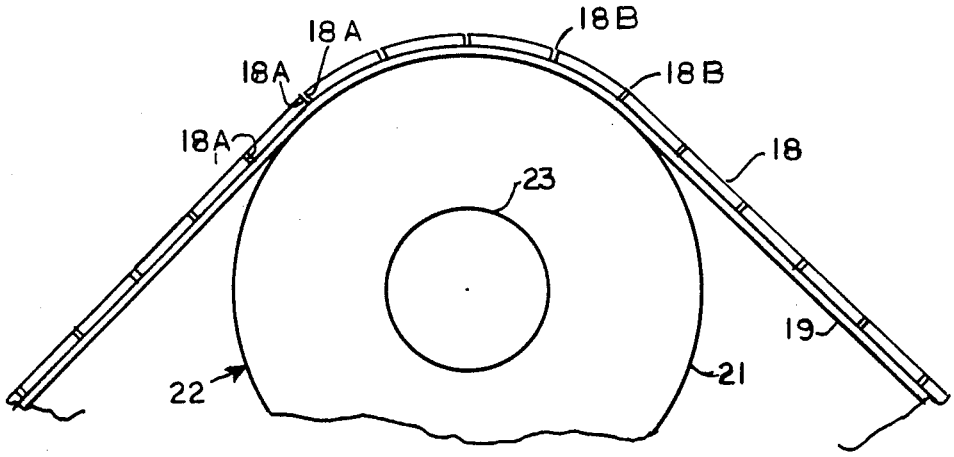
FIG. 4 is an enlarged view of butt cut labels on a web supported by an anvil roller.

A butt-cut label dispensing reel 14 includes a central sleeve 15 and spaced apart side disks 16. The reel can rotate on a spindle 17 supported by housing plate 11 to pay out a strip-like supply of butt-cut labels 18 adhered to a web 19, best shown in FIG. 3. The spindle 17 is rotatably supported by a bearing assembly carried by the housing plate 11. The butt-cut labels are arranged on the web as shown in FIG. 3 in an edge-to-edge relationship and adhered to one face of the web by an adhesive coating, e.g., a pressure sensitive adhesive. One particular characteristic of the butt-cut labels is a narrow cut line between the labels which separates the labels one from another without creating discard label material. As explained heretofore, the cut line is approximately 0.001 inch wide. As best illustrated in FIG. 4, an important discovery underlying the present invention is that the cut line between labels can be accentuated by flexing the web as by moving the web across a curved anvil surface 21 forming part of roller assembly 22 rotatably supported by bearings on spindle 23 which is in turn supported by housing plate 11. Adjacent marginal edge portions 18A of the labels will only partly separate by small separating areas 18B from the web. Separation occurs because the web flexes elastically to a much greater extent than flexing at an area where an adhesive connection exits between a label and the web. A flexing of the web in this manner was discovered to accentuate the cut line to such an extent that a light sensor can be used in a very reliable fashion to respond by an output signal when the light scanning beam passes to an accentuated cut line between labels. An electrical signal produced in this fashion can be used to control indexing of the web a distance of one label or some other desired distance for dispensing labels, one at a time.

Returning now to FIG. 1, butt-cut labels on the web pass from dispensing reel 14 along a path of travel wherein the web passes about idler rollers 24, 25 and 26 before the web wraps partly about roller assembly 22 The dispensing reel 14 can be retarded against rotation by a brake or slip clutch so that as the label carrying web wraps about rollers 24, 25 and 26, the unwound portion of the web is stressed by a forward tension with respect to roller assembly 22. The rollers 24, 25 and 26 are provided with spindles which are supported by the housing 11 and held in position by collars. The gaps created by the cuts separating the individual butt-cut labels are accentuated so that a sensor 27 can detect the cuts between adjacent labels on the web. Sensor 27 may take the form of a light emitter and a light receiver arranged in a common housing wherein the light emitter projects a light beam upon the surface of the labels. The light receiver is positioned so as to receive light reflected from the surface of the labels passing across anvil surface 21. Because the reflectivity of the face surface of the butt-cut labels is different from the reflectivity of the backing web to which the labels are adhered, when light emitted by the light emitter is reflected from the cuts between the adjacent butt-cut labels, a change in the amount of reflected light is detected by the light receiver of sensor 27. A sensor suitable for this purpose is commercially available, and may be the Photoelectric sensor LP510CV and photoelectric amplifier module B3-4 manufactured by Banner Engineering Corporation.

Figure 5:
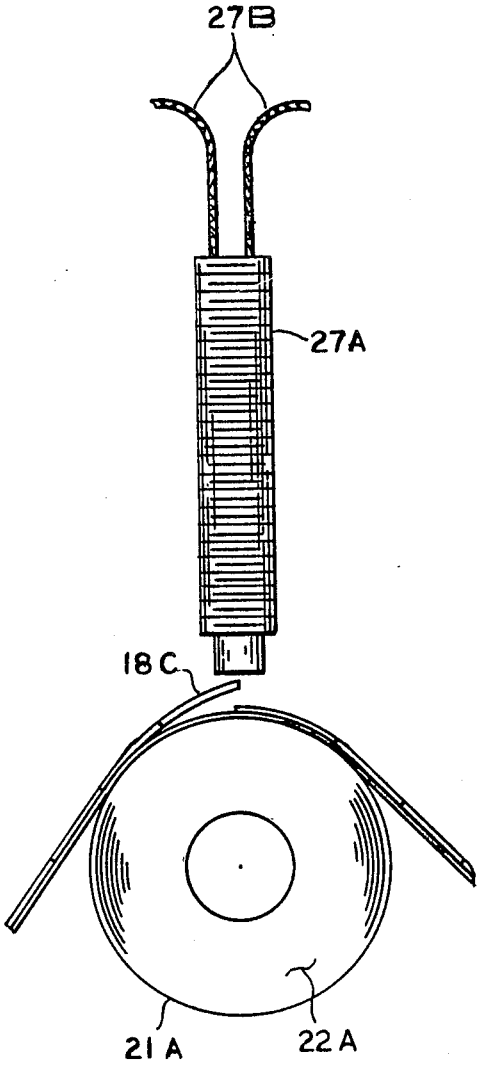
FIG. 5 is an enlarged view illustrating a proximity detector for sensing a raised marginal label edge between butt-cut labels.

The sensor 27 may take the form of an optical displacement sensor which can measure displacement without touching the object. As shown in FIG. 5, an anvil surface 21A is formed by a roller 22A having a relatively small diameter. The diameter is such in relation to the strength of the adhered coating on the label so that marginal edge portions at abutting edges of the labels are caused to release from the backing web. The rigidity of the label causes the marginal edge 18C to move toward the sensor 27A. The distance sensor detects this change in distance and produces an output electricity signal in line 27B which can be used by a controller for drive motors according to the present invention. A sensor suitable for this purpose is commercially available and may comprise an optical displacement sensor model PA-1800/1801U available from Keyence Corporation of America.

The web and butt-cut labels pass from anvil surface 21 to a peeler bar 28 secured by threaded fasteners to housing 11. Peeler bar 28 contains an elongated planar face 29 terminating at acute-angled corner 30. The peeler bar 28 is positioned such that corner 30 is located proximate to a workpiece 31 at labeling station 13 on the conveyor 12. Because of the acuteness of the angle, during operation of the present invention, the butt-cut labels are peeled from the backing paper as the web wraps around corner 30. An applicator roll 32 is mounted by a clevis onto the rod end of a piston and cylinder assembly 33 which is in turn supported by a suitable bracket, as shown in FIG. 1, attached to the housing plate 11. The applicator roll presses the label as it is stripped from the web into adhesive contact with the workpiece.

After the label is stripped from the web, the web advances toward a drive roll 34 of a pinch roll assembly 36 that includes a pressure roller 37. Roller 37 is rotatably supported at one end of a pivot arm 38 that can pivot about a spindle 39 used to rotatably support a scrap web windup reel 40. The windup reel is driven through a slip clutch 40A by a continuously operating motor 40B. The free end of pivot arm 38 is acted upon by a spring 41 supported by the housing plate to urge the roller 37 toward drive roll 34 thereby maintaining a frictional engagement of the web with the roll 34. Roll 34 is driven by a drive that essentially includes a drive motor 42. Motor 42 is controlled by a controller 43, shown here in block form, which may, for example, be comprised of a microprocessor based controller. The controller receives a signal in line 44 from sensor 27 and from a detector 45, such as a limit switch. The limit switch provides a signal to controller 43 each time a workpiece 31 moves into a label receiving position by the conveyor.

In operation, the label dispenser functions to allow butt-cut labels to be automatically dispensed onto a workpiece 31 positioned at the labeling station 13 by the conveyor 12. Once a supply of butt-cut labels is positioned upon reel 14, and unwound to allow threading about roller 24, 25, and 26, peeler bar 28, drive roll 34, roll 37, and scrap web rewind reel 40, operation of the label dispenser 10 may commence. Sensor 27 scans across butt-cut labels positioned therebeneath on the surface, the gaps created by the accentuated cuts between adjacent labels are increased. When a first cut is detected, automatic operation of the label dispenser may commence. In response to the detection of a cut, sensor 27 generates a signal which is supplied to the controller 43. When the controller receives a signal from detector 45 the controller actuates motor 42 which drives drive roll 34 of pinch roller assembly thereby causing the dispensing roll 12 to unwind. Dispensing roll 14 continues to unwind until sensor 27 detects a next successive cut line between labels. When this cut is detected, sensor 27 again generates a signal which is supplied to the controller which responds by deactuating the drive motor 42, thereby stopping advancement of the web along the peeler bar and further unwinding of the supply reel 14. Because each of the butt-cut labels have a identical length on the web, causing the supply reel 14 to unwind a length of web corresponding to the length of one label as determined by the sensing means 27, one label is also caused to be peeled away from the web as the web winds around corner 30 of the peeler bar 28. The piston and cylinder assembly 33 is then operated to move the application roll 32 toward the workpiece and press the dispensed label against the surface of the workpiece.

The piston and cylinder assembly 33 can be operated to retract the application roller and the motor 42 is deactuated. When the conveyor moves another workpiece 31 into position proximate to the label dispenser 10, the controller is then reset by a signal from limit switch 45 allowing the above-described sequence to be repeated to dispense labels on as many workpieces as desired.

Figure 6:
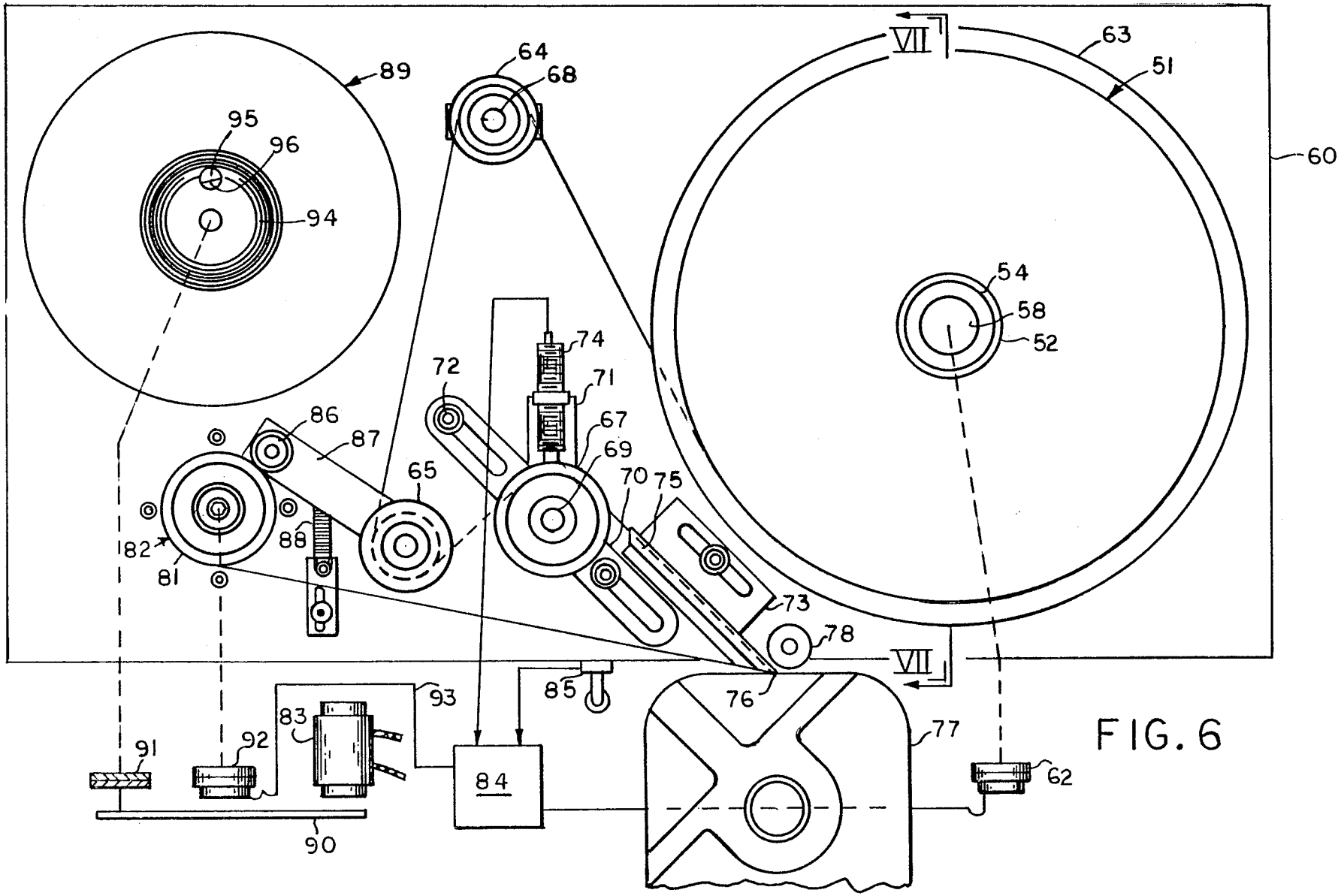
FIG. 6 is a schematic view of a second embodiment of the present invention.
Figure 7:
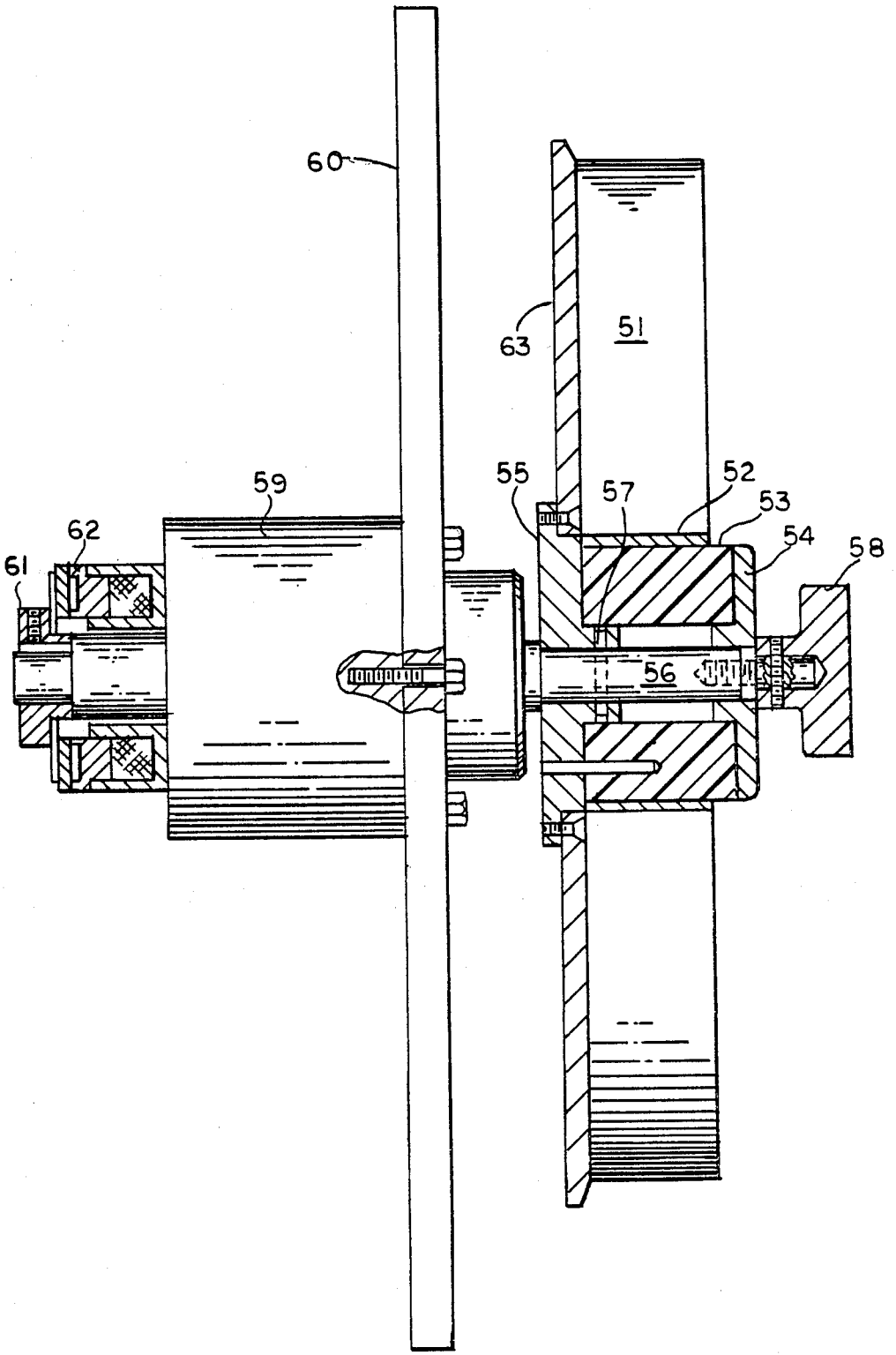
FIG. 7 is a sectional view taken along lines VII—VII of FIG. 6.

Referring now to the illustration of FIGS. 6 and 7, there is shown a second embodiment of the label dispenser of the present invention. As shown in FIG. 7, the dispenser includes a coiled supply of butt-cut labels 51 wound on a support sleeve 52 that is removably mounted on a compressible elastomeric ring 53 comprised of die spring rubber located between carrier collars 54 and 55. Collar 54 is secured to an arbor 56 by a drive pin 57. Collar 55 can slide on the arbor and a knob 58 engages the collar while a threaded shaft of the knob threadedly engages with a tapped hole in an end portion of the arbor as shown in FIG. 7. The arbor is supported by bearing assembly 59 secured to a housing plate 60. The outside diameter of the ring 53 is slightly smaller than the inside diameter of support sleeve 52 so that the elastomeric material of the ring can be compressed by tightening knob 58. To remove and replace sleeve 52 for replenishing the supply of butt cut labels, knob 58 is loosened to allow the elastic memory of sleeve 53 to shrink the sleeve to its original size. The sleeve and supply of labels are securely held on the support sleeve in a driving engagement with the carrier collars 54 and 55 without the need for fasteners or the like. An end portion of the arbor projecting beyond the bearing assembly 59 is secured to a brake collar 61 which carries a brake shoe for an electromagnetic brake 62 supported by the housing of the bearing assembly 59.

It is preferred to secure disc 63 to collar 55 to stabilize and support the supply of butt-cut labels 51. As the web containing the butt-cut labels is paid out from the supply reel, the web first wraps about support roller 64 and then passes to support roller 65 before entry of the web on a curved anvil surface 66 provided by roller 67. The rollers 64 and 65 are each rotatably supported by an arbor 68 secured to housing 60. Roller 67 is rotatably supported by an arbor 69 carried by a frame 70 having projection arms. A slotted opening in each arm can receive a threaded fastener 72 for securing the frame to housing 60. A bracket extension 71 is secured to frame 70 and supports a sensor 74 which is the same as sensor 27 described heretofore. A peeler bar 75 allows the web to wrap around a corner 76 of the peeler bar, whereat individual labels are peeled away from the web as the web moves about corner 76. In this embodiment, the position of peeler bar 75 above workpiece 77 is adjustable. The peeler bar 75 is connected to bracket 73 which has an elongated opening into which a threaded fastener 79 can pass for engagement with a tapped hole in the housing 60. The peeler bar 75 and sensor 74 including roller 67 are adjustable relative to each other. The peeler bar is adjustable in a direction toward and away from a labeling station at which workpiece 77 is located when a label is applied. The corner 76 of the peeler bar is set at a position slightly spaced from the workpiece and the web is advanced until a desired part of a leading edge of a label is stripped from the web and projects freely beyond the reversely directed part of the web at corner 76. When the freed edge portion of the label is located at a desired relation to the workpiece, fastener 79 is tightened to hold the peeler bar in place. Thereafter, the bracket 70 is moved to a position were the sensor detects a cut line between labels. The fasteners 72 are then tightened to hold the roller 67 and sensor 74 in place. By this set up procedure, the same amount of label will always be presented beyond corner 76 to engage with a workpiece.

An applicator roller 78 is supported by the housing for ensuring that the labels are reliably adhered to the workpieces as the labels separate from the backing web. The web issuing from the peeler bar wraps about a driven roller 81 of a pinch roll assembly 82. Roller 81 is driven by a drive that includes a motor 83 and a controller 84. The controller receives a signal from sensor 74 and a signal from a detector 85 such as a limit switch which responds to movement of a workpiece on a conveyor as described previously. The pinch roll assembly includes a roller 86 supported by an arm 87 that can pivot against roller 81 under pressure of a spring assembly 88. The arm 87 is supported by the same arbor which supports the idler roller 68. The web is supplied from the pinch roller assembly to a scrap wind up reel 89 which is driven by motor 83 connected by a belt 90 through a slip clutch 91. The belt 90 also drives an electrically actuated clutch 92 connected to a drive shaft for roller 81. A signal from controller 84 is delivered by line 93 to actuate clutch 92. The reel 89 includes a spindle 94 about which the scrap web is wound. A coil release pin 95 is supported in a semicircular groove at the outer peripheral surface of the spindle 94 so that a flat pin surface 96 can be rotated to face the coiled web and thereby provide a clearance space to permit removal of a coiled web from the spindle without the need to unwind the web.

The label applicator of FIG. 6 operates under control provided by controller 84. Motor 83 is turned ON and runs continuously. Slip clutch 91 transmits a limited torque to reel 89 for maintaining tension in the unwound length of the web. Clutch 92 is disengaged and electromagnetic brake 62 is energized by controller 84 to prevent unwinding of the label bearing web from supply 51. When a workpiece 77 trips limit switch 85, a signal is supplied to controller 84 which in turn energizes clutch 92 and simultaneously de-energizes brake 62. Sensor 74 delivers an electrical signal to controller 84 when a next cut line between abutting labels is detected thereby causing controller to energize brake 62 and simultaneously de-energize clutch 92. The torque provided by through clutch 91 and the continuously operating motor 83 assures the newly created length of scrap web is taken up on reel 89 while maintaining tension on the web.

Figure 8:
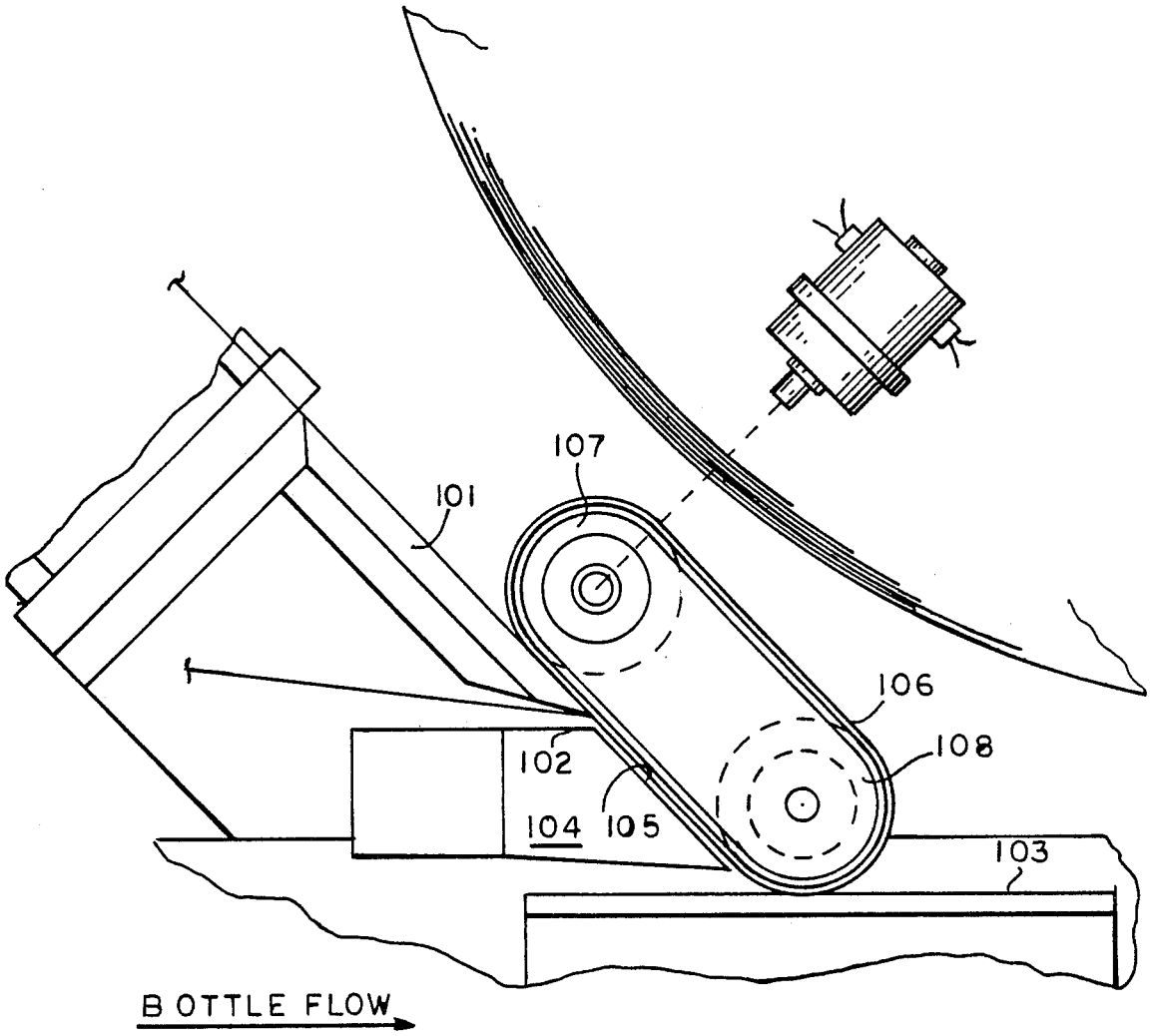
FIG. 8 is an enlarged view of a preferred embodiment of a label applicator for the dispenser of the present invention.

In FIG. 8 there is illustrated a preferred embodiment of an applicator for carrying a label after it is stripped from the web onto a workpiece. The peeler bar 101 which is constructed in essentially the same manner as the peeler bars described hereinbefore and directs a web having butt-cut labels adhered thereto along a planar face surface to a corner 102 which is spaced at a distance from a surface 103 of a workpiece to receive a butt-cut label. In the gap between the surface 103 and the peeler bar, there is provided an air shoe 104 which is essentially an enclosed conduit having an air discharge grid 105 directed toward, in a confronting relation, a face surface of an endless belt 106 which is supported by spaced apart pulleys 107 and 108 driven by an electric motor 109 and controlled by the same controller which controls the start and stop operation of the applicator. If desired, motor 83 can be used to drive pulley 107 whereby motor 109 may be eliminated and applicator belt will run continuously. As a butt-cut label is stripped from the web at corner 102 a stream of air emitted from grid 105 forces the label against the belt 106 which moves in a direction to carry the label from the peeler bar to the face surface 103 of the article to receive the label. As the label engages the face surface 103, the portion of the belt wrapping about the outer peripheral part of pulley 108 applies pressure to the face surface of the label for ensuring the desired adhesive attachment.

Figure 9:
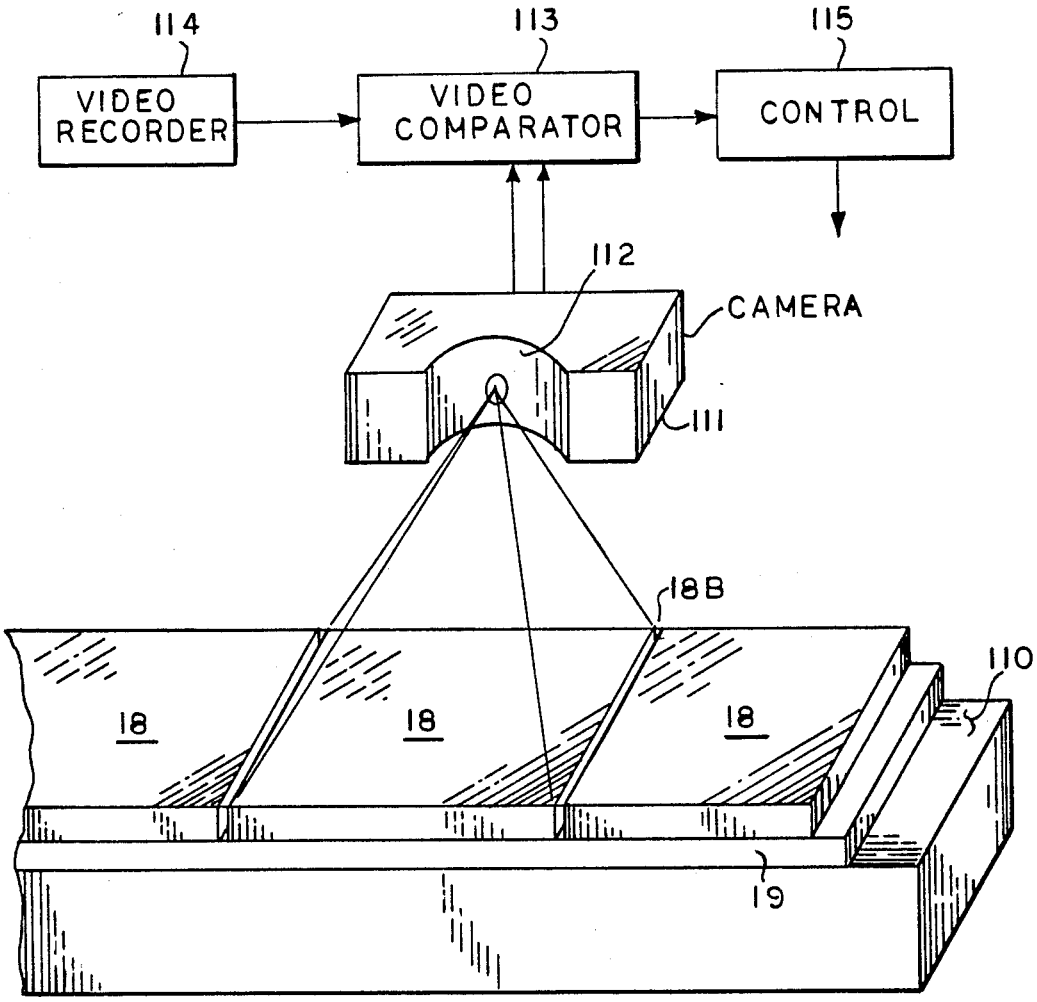
FIG. 9 is an isometric view of a portion of a label scanning apparatus according to a third embodiment.

Turning now to FIG. 9, there is illustrated a still further embodiment of the present invention, which differs from those embodiments described hereinbefore by the form of the sensor used to sense and index the web containing abutting labels. In this embodiment, there is a planar face surface 110 which can be an upstream extension of the peeler bar along which web 19 can pass. The planar face surface 110 supports the web. Directed toward the adhered labels is a video camera generally identified by reference numeral 111 having a lense 112 which is brought into focus with a field of view corresponding to a predetermined area such as one label. The predetermined area of the view by the camera can be a part of a label or some reference indicia on a label. The video signal provided by the camera is delivered to a video comparator 113 which also receives the output signal from a video recorder 114. The video recorder provides an electrical signal corresponding to an image of a label or some predetermined part of a label. The video comparator compares the signal provided by the video camera and the signal provided by the video recorder so that when the signal from the video recorder corresponds to the signal from the video camera, an output signal is delivered to a controller 115 for the label applicator. The controller in turn delivers a signal to a drive for the label applicator as described hereinbefore. In this way, the data displayed on the face of the label is used as an accentuating medium and forms a distinguishable characteristic which can be used for indexing the labels one at a time for discharge from the peeler bar onto a workpiece.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What I claim is:

1. In a butt-cut label dispensing apparatus for dispensing butt-cut labels carried by a web onto an article, the labels adhering to the web and the article being positioned along the path of travel of the web, wherein abutting ones of said butt-cut labels until dispensed by said apparatus are separated only by cut lines, the cut lines being characterized by being relatively non-detectable when in a flat condition by a reflective type sensor and the labels consisting of a single thickness, the apparatus including means for supporting the web in a general flat condition in its path of travel, a convex surface arranged in the path of travel of the web to cause the web to take the path formed by the curved surface, means for tensioning the web, and sensing means directed towards the labels while passing over the curved surface, the improvement;

said curved surface having a curvature in relation to the strength of the adherence between the web and labels so as to cause the cut line portions of the labels to release from the web in a manner so as not to cause relative movement between adjacent butt-cut labels but to only accentuate said cut line portions of abutting butt-cut labels by tending to lift said portions away from the web, said tension means including means for applying a sufficient tension to the web in conjunction with the degree of curvature of said curved surface to enhance said releasing and lifting action of said cut line portions of abutting butt-cut labels carried by the web in a manner not to cause any relative movement of adjacent butt-cut labels, and wherein said sensing means comprises a reflective type optical sensor means having means for detecting only the accentuated cut lines of the labels, and being arranged on the side of said web most adjacent said labels.

2. The butt-cut label dispensing apparatus according to claim 1 wherein said sensing means includes a video camera.

3. The butt-cut label dispensing apparatus according to claim 2 wherein said sensing means further includes a comparator for comparing a video signal from said video camera with a desired video signal.

4. The butt-cut label dispensing apparatus according to claim 3 wherein said sensing means further includes a video recorder for producing said desired video signal.

5. The butt-cut label dispensing apparatus according to claim 1 wherein said sensing means includes a light emitter and a light detector responsive to differences in light reflective properties across said cut lines between abutting labels.

6. The butt-cut label dispensing apparatus according to claim 1 wherein said curved surface includes an anvil member with a convexly curved circumferential face surface about which said web can wrap.

7. Butt-cut label dispensing apparatus for dispensing butt-cut labels from a carrying web onto an article wherein abutting ones of said butt-cut labels until dispensed by said apparatus are separated only by cut lines, said apparatus including:

a supply reel including an arbor to support for unwinding a coiled web with butt-cut labels while in said butt-cut relationship and while adhering to one face of the web for delivering butt-cut labels to the article;

means including a curved surface along which said web passes arranged to be contacted by the web and having a curvature in relation to the strength of the adherence between the web and labels so as to cause the cut line portions of the labels to release from the web in a manner so as not to cause relative movement between adjacent butt-cut labels but to only accentuate said cut line portions of abutting butt-cut labels by tending to lift said portions away from the web;

means to tension said web sufficiently in conjunction with the degree of curvature of said curved surface to enhance said releasing and lifting action of said cut line portions of abutting butt-cut labels carried by the web in a manner not to cause any relative movement of adjacent butt-cut labels;

optical sensing means directed toward said accentuated edge portions while the butt-cut labels are still in contact with said curved surface and while carried by the web for producing an electrical signal in response to identifiable indicia by scanning the accentuated cut lines of abutting labels;

peeler means arranged after said curved surface means and adjacent the article for further releasing at least an adhered part of a butt-cut label from the web; and drive means responsive to said electrical signal for controlling advancement of the web a predetermined distance with respect to said peeler means to dispense a butt-cut label from the web onto the article.

8. The butt-cut label dispensing apparatus according to claim 7 further including applicator means for directing a label from said peeler means onto an article.

9. The butt-cut label dispensing apparatus according to claim 7 wherein said drive means includes a pinch roller assembly, and a drive motor drivenly connected to rotate a roller of said pinch roller assembly.

10. The butt-cut label dispensing apparatus according to claim 7 further including control means responsive to said electrical signal generated by the sensing means for controlling the operation of the drive means such that the drive is actuated when an article is sensed and deactuated when a following cut between abutting labels is sensed by the sensing means.

11. The apparatus of claim 7 wherein said arbor includes a rotatable spindle for rotatably supporting said web including labels in a coiled form.

12. The butt-cut labels dispensing apparatus of claim 7 wherein said sensing means includes a light emitting means and a light receiving means, with said light emitting means emitting light toward labels on a face surface of the web, and the light receiving means receiving light reflected from at least the surface of the labels, said light receiving means generating a signal during those times in which the amount of reflected light is altered due to reflection of light from cuts between adjacent butt cut labels on the web.

13. The butt-cut label dispensing apparatus according to claim 7 further including brake means for preventing delivery of the label bearing web from said supply reel until the brake means is released in response to said electrical signal.

14. The butt-cut labels dispensing apparatus according to claim 7 further including a wind up reel for web after removal of labels therefrom, said drive means including a slip clutch driven by a motor to maintain the web under tension.

15. The butt-cut label dispensing apparatus according to claim 7 wherein said supply reel includes an expandable carrier for a coiled supply of label burden web and means for expanding said carrier into a supporting and drive relation with the coiled supply of label burden web.

16. The butt-cut label dispensing apparatus according to claim 15 wherein said means for expanding includes collars at opposite sides of said expandable carrier and adjustable means for moving said collars toward each other to compress said expandable carrier for expansion thereby.

17. The butt-cut label dispensing apparatus according to claim 16 wherein said adjustable means includes an arbor for supporting said collars with one collar secured to the arbor and the other collar slidable thereon, and a control knob threadedly engaged with said arbor adjacent to the slidable collar for forcing the collars toward each other to expand said expandable carrier between the collars.

18. The butt-cut label dispensing apparatus according to claim 17 wherein said expandable carrier includes a die spring rubber sleeve.

19. The butt-cut label dispensing apparatus according to claim 7 further including a wind up reel including a spindle upon which a web after removal of labels therefrom can be wound, and means for releasing a wound web from said spindle.

20. The butt-cut label dispensing apparatus according to claim 19 wherein said means for releasing includes a release pin rotatably supported at a peripheral edge of said spindle.

21. The butt-cut label dispensing apparatus according to claim 20 wherein said release pin has a flat relief surface which can be turned toward a coiled web on the spindle to produce a clearance therebetween.

* * * * *